US006139792A

United States Patent [19]

Kibble et al.

[11] Patent Number: 6,139,792

[45] Date of Patent: Oct. 31, 2000

[54] EXCHANGE OF AN OXYGEN LANCE FOR LIQUID STEEL CONVERSION

[75] Inventors: Brian James Kibble, Yarm; Ian Mervyn Craig, Hartburn, both of United Kingdom

[73] Assignee: Kvaerner Davy Ltd., Stockton-on-Tees, United Kingdom

[21] Appl. No.: 09/155,963

[22] PCT Filed: Feb. 6, 1997

[86] PCT No.: PCT/GB98/00376

§ 371 Date: Oct. 13, 1999

§ 102(e) Date: Oct. 13, 1999

[87] PCT Pub. No.: WO98/35065

PCT Pub. Date: Aug. 13, 1998

[30] Foreign Application Priority Data

Feb. 7, 1997 [GB] United Kingdom ..... 9702507

[51] Int. Cl.[7] ..... C21C 5/32

[52] U.S. Cl. ..... 266/225

[58] Field of Search ..... 266/225, 226, 266/217, 268

[56] References Cited

U.S. PATENT DOCUMENTS

| | | | |
|---|---|---|---|
| 3,170,977 | 2/1965 | Obenchain | 266/225 |
| 4,732,370 | 3/1988 | Berry et al. | 266/225 |
| 5,377,960 | 1/1995 | Leczo et al. | 266/225 |
| 5,865,876 | 2/1999 | Watkins et al. | 266/225 |

FOREIGN PATENT DOCUMENTS

| | | |
|---|---|---|
| 0 372 099 | 6/1990 | European Pat. Off. . |
| 2207190 | 6/1974 | France . |
| 87 15 099 | 2/1988 | Germany . |
| 87388 | 11/1989 | Luxembourg . |
| 1136167 | 12/1968 | United Kingdom . |
| 1320680 | 6/1973 | United Kingdom . |
| 1494693 | 12/1977 | United Kingdom . |
| 1598740 | 9/1981 | United Kingdom . |
| 97/17474 | 5/1997 | WIPO . |

*Primary Examiner*—Scott Kastler

*Attorney, Agent, or Firm*—Fay, Sharpe, Fagan, Minnich & McKee, LLP

[57] ABSTRACT

An oxygen lance assembly includes a lance body which can be coupled and decoupled from a head through the use of a plug and socket junction. The plug part of the junction can be located on the lance body and provided with a plurality of axially spaced cylindrical male sealing surfaces. These are adapted to mate with corresponding female sealing surfaces provided in the head. The sealing surfaces mate with a clearance and the required seal is achieved by mounting O-rings exclusively on each male sealing surface. This provides for convenient inspection of the O-rings. Damage to the O-rings caused by vibration is prevented by cylindrical guide surfaces having a close sliding fit which serve to keep the plug part coaxial in the socket. Alignment of the plug in the socket is achieved by increasing the radius of each cylindrical sealing surface the further it is from the top of the socket via frusto-conical guide surfaces.

25 Claims, 6 Drawing Sheets

EXCHANGE OF AN OXYGEN LANCE FOR LIQUID STEEL CONVERSION

The present invention is concerned with the structure and process of exchange of an oxygen lance for use in the conversion of iron to steel.

In the process for the conversion of pig iron to steel oxygen is blown onto or through the top surface of molten pig iron and scrap contained in a converter vessel. In this specification oxygen is to be taken to be any gas, including air, or mixtures of gases, which might be blown onto the pig iron/steel mixture unless otherwise stated.

A conventional oxygen lance assembly consists of a lance body coupled to a head. The lance body is comprised of at least an inner pipe, intermediate pipe and an outer pipe arranged concentrically. The inner pipe provides an oxygen passage to deliver oxygen from the normally upper head end to a lower tip end from which it is expelled. The annular spaces between the pipes provide a water passage whereby water coolant is pumped from the head to the tip and returned to the head. The head provides means to couple the lance body to oxygen and water supplies. The lance body has to be changed frequently because it deteriorates rapidly in the hostile working environment and for process reasons.

A conventional lance assembly is known from U.S. Pat. No. 3,170,977. U.S. Pat. No. 3,170,977 illustrates a lance assembly known as a plug and socket system. In this assembly the lance body has a head end in the form of a plug which plugs into a head in the form of a socket. In use the head is permanently supported on a gantry. Various pipes are connected to ports in the head whereby oxygen and coolant fluids can be delivered to and circulated in the lance. The head end of the innermost pipe projects from the head end of the intermediate pipe which in turn projects from the head end of the outer pipe. Thus cylindrical peripheral male mating surfaces are exposed on each pipe. Within the socket of the head, cylindrical female peripheral mating surfaces are provided which engage with the exposed male mating surfaces of each pipe. Thus, when the lance body is plugged into the head socket axially spaced annular chambers are formed which communicate with water delivery and return ports in the head and with the corresponding passages in the lance body. The inner pipe sockets directly into an inner pipe aperture communicating with the oxygen delivery port in the head. To prevent water leaks into the oxygen passage a pair of O-ring seals are retained in annular channels formed the female mating surface which receives the inner pipe mating surface.

The lance head is coupled to the lance body by means of hooks formed on one of the lance head and body which engage with pins formed on the other of the lance head and body. To exchange a lance body, the lance body is first engaged and suspended by means of a crane. The pins are released from the hooks and the old lance body displaced axially to withdraw the head end from the socket in the head and is then carried away. A replacement lance body is carried in by a crane. The head end of the replacement lance body must then be accurately aligned coaxially so that the sealing surfaces, which have sliding fit tolerances, can be slid into engagement by having the crane raise the lance body. The hooks are then engaged with the pins to retain the lance body in the head and the crane is withdrawn.

The lance body and head are heavy and the lance body has a large moment of inertia. The lance body is suspended from a crane via a hook and trunnion pin arrangement. The crane operator is also necessarily remote from the head and must be guided by an assistant on a gantry supporting the head, it is consequently difficult to accurately align the head and lance body.

The aforementioned problems experienced with aligning the conventional lance body and head must be obviated in order to automate the exchange of the lance body.

Because there is a close sliding fit tolerance between the mating surfaces, the mating surfaces are subject to wear from abrasion and this encourages corrosion so reducing the endurance of the lance body and the head.

Because the respective mating surfaces of the head and lance body must pass over each other as the lance body is introduced to the head, there is a serious risk of the O-rings being damaged. Because the O-rings are retained in the head socket they are difficult to inspect and maintain.

In order to alleviate the technical problems exhibited by the aforementioned prior art there is provided an oxygen lance assembly comprising:

a head and a lance body, a plug part being formed on one of the lance body or the head, a socket being formed in the other of the lance body or the head to receive the plug part and so form a plug and socket junction, the plug part having a plurality of cylindrical peripherally extending axially spaced exclusively male mating surfaces and, the socket having a plurality of cylindrical peripherally extending exclusively female mating surfaces spaced axially to cooperate one each with each male mating surface to separate passages for the transport of oxygen or coolant through the plug and socket junction, at least one annular sealing element mounted to engage between cooperating male and female mating surfaces, characterised in that, the sealing element is mounted to be retained on the male mating surface of the plug.

Preferably the socket is formed in the head and the plug part on the lance body.

Preferably conic guide surfaces are provided radially spaced from the mating surfaces arranged to progressively correct any misalignment of the mating surfaces before the mating surfaces engage during installation of the plug part in the socket. The guide surfaces may also comprise cylindrical surfaces. The cooperating cylindrical guide surfaces on the plug part and the socket may have a sliding fit tolerance and cooperating mating surfaces on the socket and the plug part may have a clearance so that cooperating mating surfaces do not touch. A virtue of this is that wear on the O-rings and mating surfaces is reduced.

Preferably at least one cylindrical guide surface on the plug part is disposed to engage with the cooperating cylindrical guide surface in the socket before the mating surfaces on the socket and plug part engage. This ensures that the male and female mating surfaces are accurately aligned during installation.

Because there is little or no wear on the mating surfaces it may be worthwhile that at least some of the mating surfaces are coated to resist corrosion. Also components of the head which come in contact with water may be made from costly but corrosion resistant materials such as stainless steel because the abrasive wear to which the prior art assembly is subject is alleviated. Thus it may be economic to make a skirt of the head from stainless steel because the skirt provides the female mating surfaces exposed to water.

Preferably the sealing elements are O-ring seals retained in annular grooves. However, lip seals or other elastomer seals having appropriate mountings could be used.

To minimise abrasion it is preferable that the radius of each mating surface is greater than that of any mating surface closer to the socket end of the plug part.

According to a second aspect of the invention an oxygen lance assembly comprises:

a head and a lance body, a plug part formed on one of the head or lance body, a socket formed in the other of the head or lance body to receive the plug part and so form a plug and socket junction, the plug part having male mating surfaces provided by a plurality of cylindrical peripherally extending axially spaced surfaces and, the socket having a plurality of cylindrical peripherally extending female mating surfaces spaced axially to cooperate one each with each male mating surface to isolate passages for the transport of oxygen or coolant through the plug and socket junction, characterised by the provision of guide surfaces on at least one of the socket or plug part whereby the plug part and the socket are accurately aligned before the mating surfaces overlap.

According to a third aspect of the present invention a lance body exchange system comprises a lance assembly having a lance head, an exchangeable lance body, and a support structure, said lance body having a suspension means adapted for cooperation with said support structure whereby the lance body can be statically suspended while the lance head is displaced vertically to effect the connection and/or disconnection of the lance head from the lance body.

Preferably the support structure comprises vertically extending guide channels and a retractable support arm capable of engaging suspension means provided on the lance body.

The head may be supported on a vertically displaceable carriage mounted on the support structure.

A clamping arm may be extensible mounted on the carriage to engage suspension means remote from the head on the lance body so that the lance body can be clamped to the head and the carriage for use.

It will be appreciated that in this aspect of the invention the improvement lies in not having to provide a crane to vertically displace or hold the lance body for presentation of mating faces on the lance body with mating faces on the lance head in order to effect a junction of the lance head and body. Also, the lance body is clamped into the head by the clamping arm at a position remote from the head. This provides good control of the lance during use by helping to damp vibrations caused by the violent turbulent flow of the fluids.

According to a fourth aspect of the present invention there is provided a process of exchanging an oxygen lance body attached to a lance head comprising the steps of:

statically supporting the lance body, unclamping the junction of the lance body and the lance head and lifting the lance head away from the lance body, statically suspending a replacement lance body, lowering the lance head onto the replacement lance body so that the weight of the lance head forces mating surfaces of the lance head together with the mating surfaces of the lance body, clamping the lance head to the lance body ready for use.

The process preferably comprises the step of statically supporting the used and/or replacement lance body by means other than a crane during attachment or detachment of the lance head.

An oxygen lance assembly, a system for exchanging a lance body of an oxygen lance assembly, and a process of exchanging an oxygen lance body attached to an oxygen lance head, embodying the present inventions will now be described, by way of example only, with reference to the accompanying illustrative drawings, in which:

Figure 1:
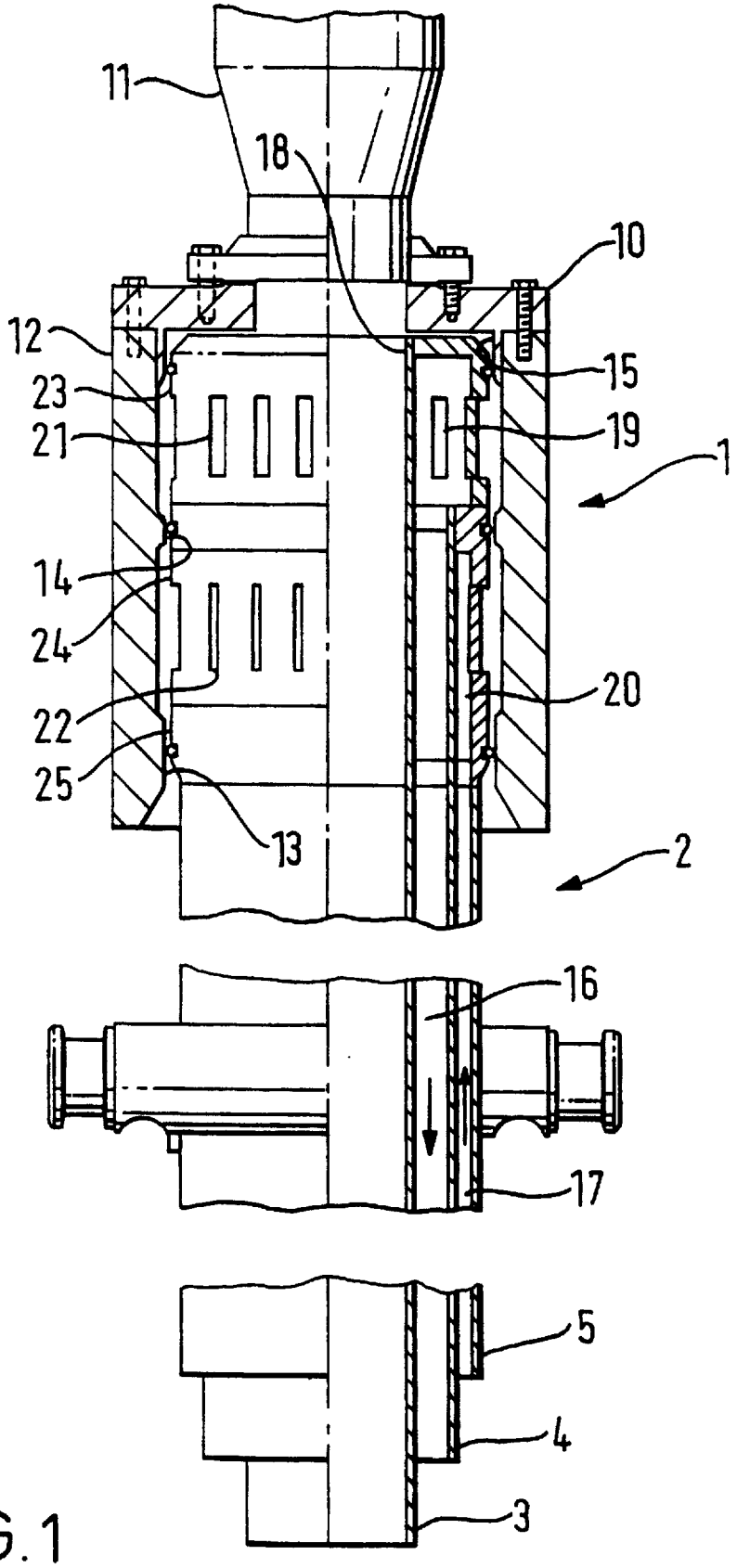
FIG. 1 is a partially sectioned view of a first embodiment of the oxygen lance assembly.

In the embodiment shown in FIG. 1, a lance head is generally indicated by the arrow 1 while a lance body is indicated by the arrow 2. The lance head I is assembled from an annular flange 10, which is preferably made of a non-ferrous inert material such as bronze. An oxygen supply hose 11 is bolted on to the flange 10 to deliver oxygen through the aperture in the flange 10. An elongate skirt 12 made of steel is secured by bolts to depend from the flange 10. Ports (not shown) for the input and output of coolant water are provided, vertically spaced, in the skirt 12. The interior surface of the skirt is substantially vertical but provided with two cylindrical vertically spaced female mating surfaces 13 and 14 which stand proud of the nominal interior surface. A third mating surface 15 is formed by a shoulder portion of the flange which depends inside the skirt 12. The surfaces inside the head form a socket.

The lance body is assembled from an inner oxygen pipe 3, an intermediate surrounding pipe 4 and an outer pipe 5. The pipe 3 provides a passage for oxygen to pass to a tip of the lance assembly. The annular space between the intermediate pipe 4 and the inner pipe 3 provides a coolant delivery passage 16 for transport of coolant water from the head end of the lance body towards the tip. An annular passage between the intermediate pipe and the outer pipe provides a coolant return passage 17.

At the head end of the oxygen pipe 3 the oxygen passage communicates with an open aperture 18. The coolant delivery passage 16 communicates with an annular coolant delivery chamber 19 formed in a manifold. The manifold also provides an annular coolant return chamber 20 which communicates with the coolant return passage 17. The coolant return chamber 20 is located beneath the coolant delivery chamber 19 and surrounds a portion of the coolant delivery pipe 4. A first ring of coolant delivery ports 21 is provided in the wall of the manifold part defining the coolant delivery chamber 19. A second ring of coolant return ports 22 is formed in the wall of the manifold part defining the coolant return chamber 20.

A first male cylindrical mating surface 23 is provided on a raised ridge extending around the outside of the manifold immediately above the coolant delivery ports 21. A second cylindrical male mating surface 24 is provided on a raised ridge extending around the manifold between the first ring of ports 21 and the coolant discharge ports 22. A third cylindrical male mating surface 25 is provided on a raised ridge extending around the manifold immediately beneath the coolant discharge ports 22. Each of the mating surfaces 23,24,25 is provided with an O-ring seal located in an annular groove.

In use the lance body 2 is statically supported. The lance head 1 is lifted onto the manifold and the weight of the lance head assists in pushing the lance head 1 onto the manifold as shown in FIG. 1. In this condition the mating surfaces 23,24,25 and the O-ring seals of the manifold mate with the mating surfaces 13,14,15 of the head to form an oxygen delivery chamber, a coolant delivery chamber and a coolant return chamber. The oxygen delivery chamber is formed at the top of the head for the delivery of oxygen through the aperture 18 to the oxygen passage in the pipe 3. A coolant delivery chamber is formed between the mating surfaces 23,15 and 24, 14 and provides for the delivery of coolant from the coolant delivery port in the skirt 12 through the coolant delivery ports 21. The third chamber is formed between the mating surfaces 14, 24 and 13,25 and provides for the passage of return coolant from the ports 22 to a water return port in the skirt 12.

The weight of the lance head 1 holds it in place while it is being clamped to the lance body 2. The assembled lance is then ready for use.

After use the exhausted lance body is removed by the reverse of the installation procedure.

Figure 2:
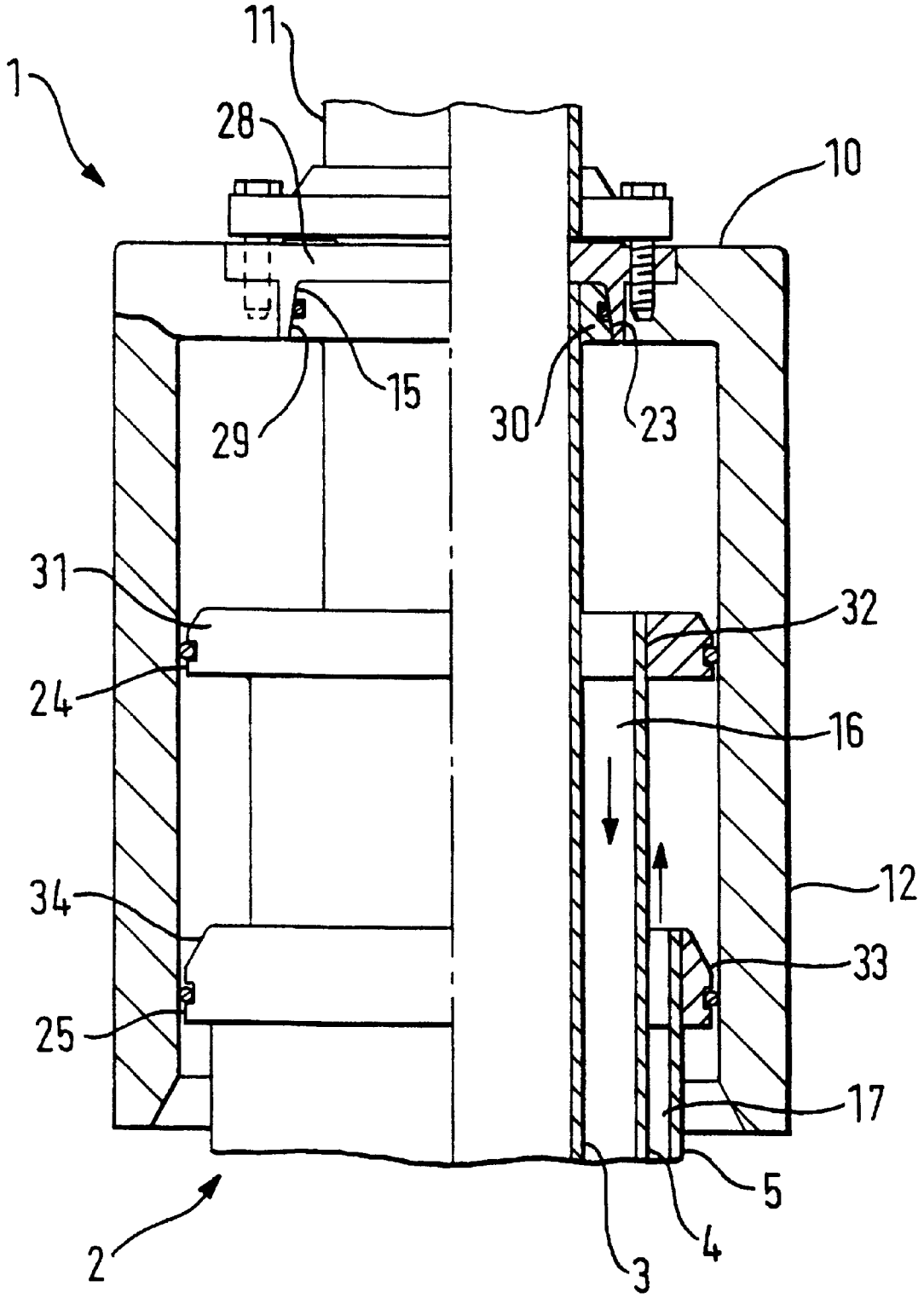
FIG. 2 is an axially split section view of a second embodiment of the lance assembly.

Referring to the second embodiment of the invention illustrated in FIG. 2, components corresponding to those of the first embodiment are designated by the same numerals. The lance head 1 differs from that of the previous embodiment in that the annular flange 10 and the skirt 12 are a unitary structure of steel. An annular insert 28 of an inert material such as bronze is received into the aperture in the flange 10. The insert has a socket 29 machined into its underside to provide a mating surface 15 and to receive a complimentarily shaped hollow plug 30 formed onto the end of the oxygen pipe 3 with a cooperating mating surface 23. An O-ring seal is located in the mating surface 23. The mating surfaces 15 and 23 taper to guide the plug and socket centrally.

The head end of the intermediate pipe 4 is spaced downwardly from the plug 30 and provided with a radially extending flange 31 which provides the mating surface 24. An O-ring seal is provided in a groove in the radially outer surface of the flange 31 which seals against the inner surface of the skirt. A leading edge of the flange 31 is provided with a tapering guide surface 32. The flange 32 extends radially out from the plug 30 and so tends to centre the plug as the lance head 1 is lowered. A water delivery chamber is thus formed between the annular flange 10, the plug 30, skirt 12 and oxygen pipe 3 and coolant passes through the coolant delivery port in the skirt (not shown) into the chamber and from the chamber directly into the annular delivery passage 16.

The end of the outer pipe 5 is secured spaced down from the flange 31 and provided with a flange 33 which provides a mating surface 25 which mates with the inner surface of the skirt 12. The inner surface of the skirt 12 is of uniform radius. An O-ring seal is located in a groove in the mating surface 25. Thus a coolant return chamber is formed between the flange 33, intermediate pipe 4, flange 32 and skirt 12. Coolant is returned to the chamber directly from the return passage 17 and passes from the chamber through a coolant return port (not shown) formed in the skirt. A tapered guide surface 34 is provided on the leading edge of the flange 33.

The second embodiment of the lance assembly does not require a complex manifold formation on the head end of the lance body. Further the provision of raised mating surfaces on the inside of the skirt is obviated simplifying production. Because the flanges 31 and 33 extend radially outwards from the plug 30, the plug is accurately centred by the time the socket 29 is lowered on to it thus reducing the risk of damage to the mating faces 15, 23 and ensuring a good seal between the coolant delivery chamber and the oxygen passage.

Figure 3:
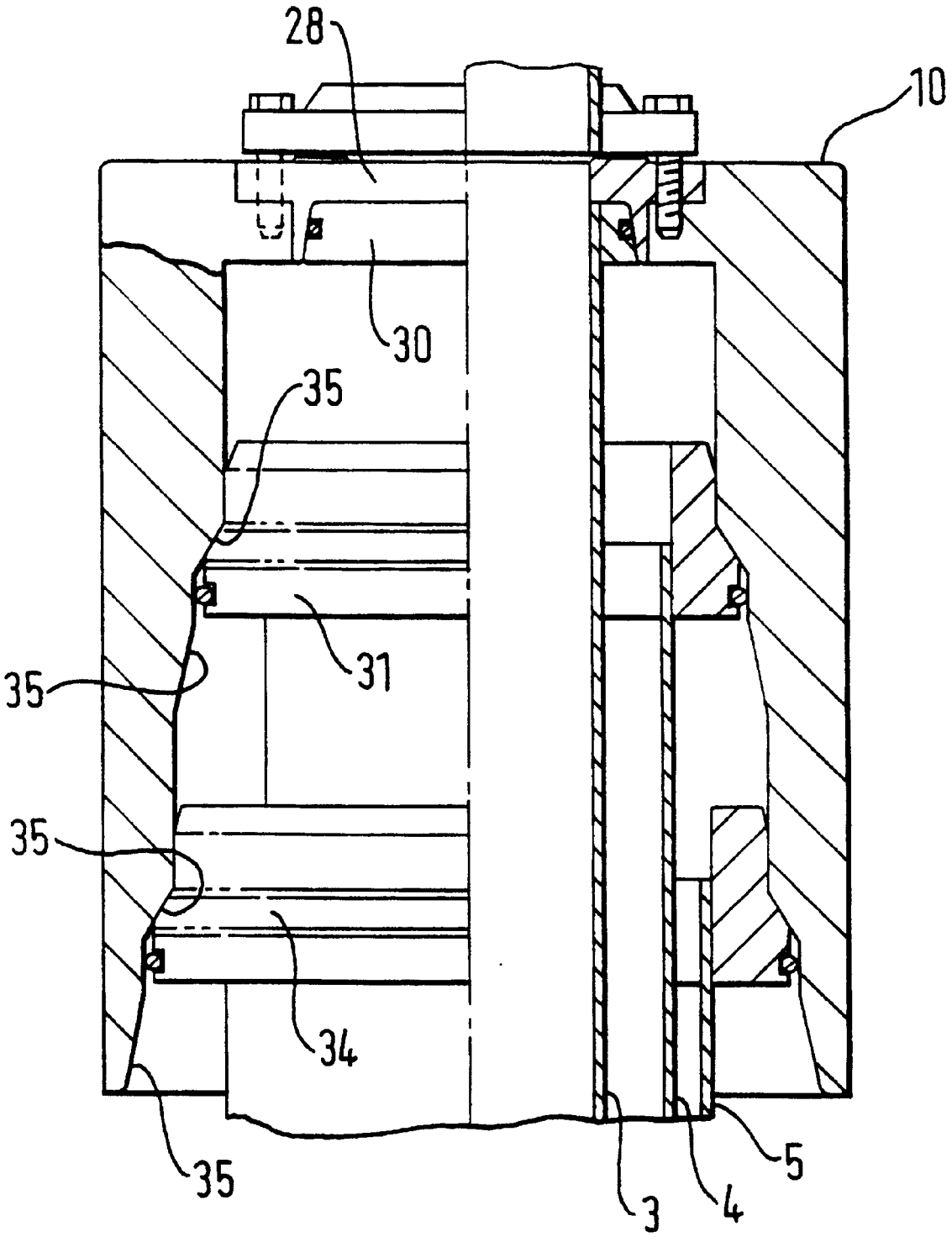
FIG. 3 is an axially split section view of a third embodiment of the lance assembly.

The third embodiment illustrated by FIG. 3 is generally similar to the second embodiment but differs in that the inner surface of the skirt has a stepped taper and the flange 34 extends radially outwards from the flange 31. This means that less precision is required in initially locating the lance head 1 over the end of the lance body since the tapered guide surfaces 35 formed inside the skirt act to centre the lance body 2.

The process of inserting and separating a lance body in the lance head is the same in the case of each embodiment.

Figure 4:
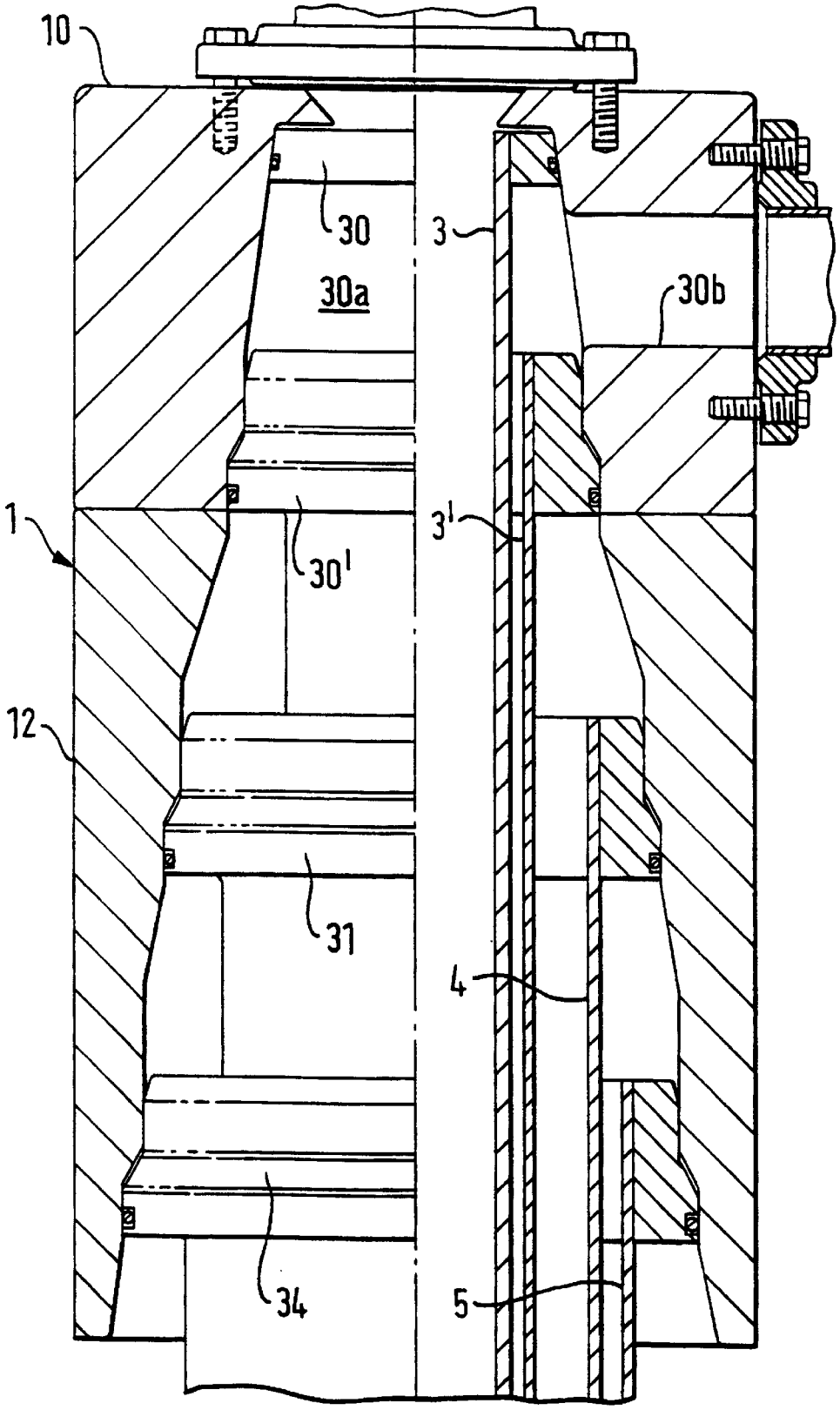
FIG. 4 is an axially split section view of a fourth embodiment of the lance assembly.

In some applications it is desirable to have additional passages for the delivery of gases such as oxygen or other gases to a secondary nozzle at the tip of the lance body where the gases are used for post combustion of the steel making gases. Additional passages for these purposes have previously been provided by means of inlet ports further down the lance body. The fourth embodiment of the invention shown in FIG. 4 provides an additional oxygen pipe 3' between the inner oxygen pipe 3 and the intermediate pipe 4. A flange 30' of bronze is formed onto the end of the pipe 3' to provide a mating surface for cooperation with a mating surface formed in the skirt 12. An additional oxygen chamber **30*a* is thus formed between the plug 30, the oxygen pipe 3 and the skirt 12. An additional oxygen delivery port 30*b*** is formed in the side of the skirt.

In the fourth embodiment the flange 10 and an upper portion of the skirt 12 are formed from inert material such as bronze so that steel from which the rest of the lance body is formed does not come into contact with the oxygen.

Figure 5:
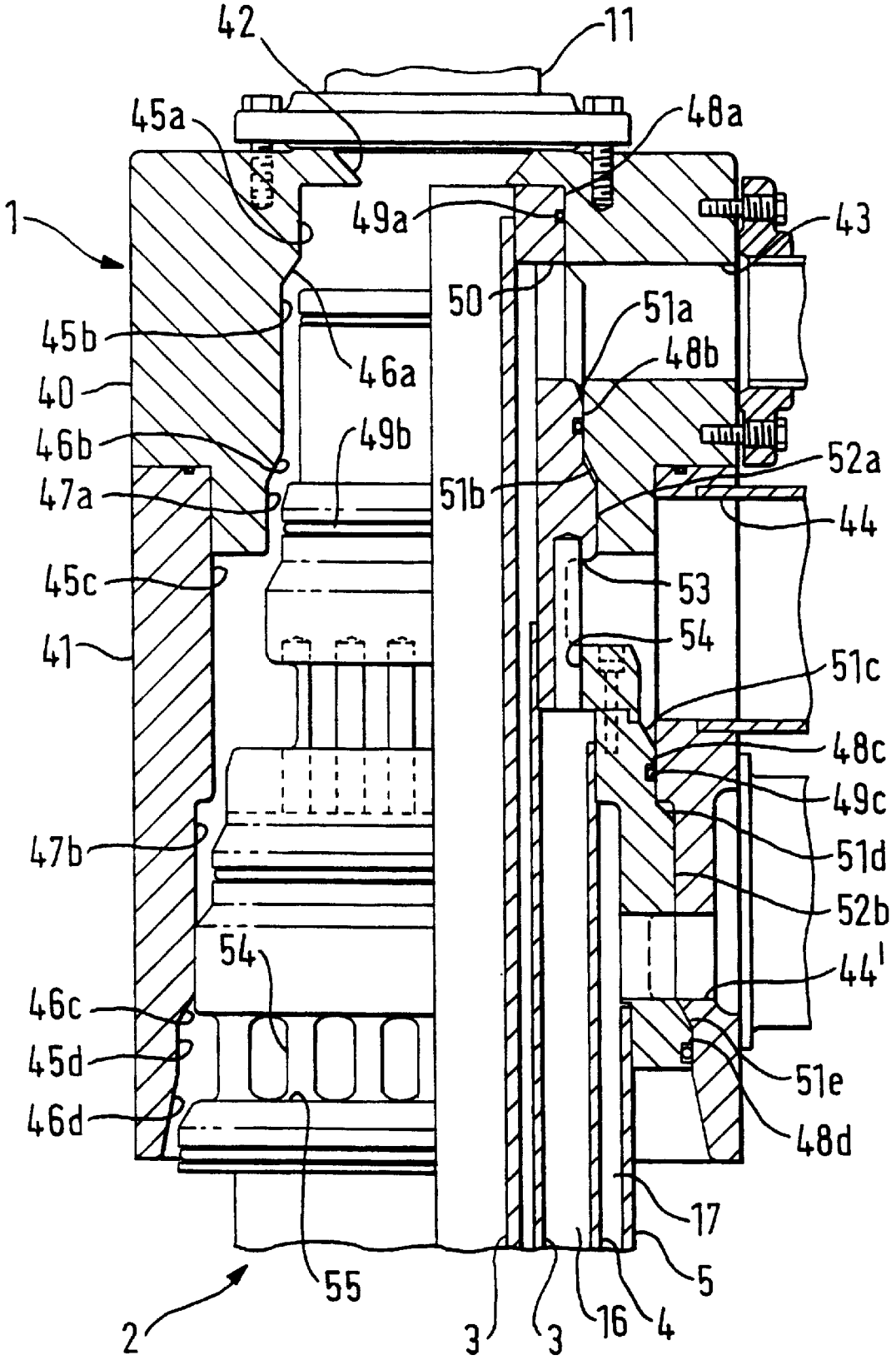
FIG. 5 is an axially split multiple section of a plug and socket head assembly with the plug partially received into the socket on the left hand side and the plug fully received into the socket on the right hand side.

FIG. 5 illustrates a fifth embodiment of the invention and shows the head 1 and the top end part of the lance body 2. In the fifth embodiment the mating surfaces are provided by sealing surfaces which do not touch.

The head 1 is formed from a hollow cylinder 40 and a skirt 41 which depends from the cylinder 40. An oxygen port 42 is provided on the axis through the top of the cylinder 40 so that in use an oxygen delivery hose 11 can be coupled to the head 1. A post burn oxygen delivery port 43 is formed through a side wall of the cylinder 40 to which a post burn oxygen delivery hose can be coupled. It may be noted that the post burn oxygen delivery port may be omitted in some embodiments of the invention. A coolant water delivery port 44 is formed through the skirt so that a coolant water delivery hose can be coupled to the head 1 to deliver water to the head. A water return port 44' is formed lower in the head to which a return hose can be coupled for the recovery of hot water after circulation through the lance assembly.

A socket is formed within the head by means of axially spaced cylindrical peripherally extending sealing surfaces and means defining guide surfaces adapted to accurately align the sealing surfaces during insertion of the plug part in the socket before cooperating pairs of the sealing surfaces overlap. The guide surfaces include surfaces which may be continuous or discontinuous around the periphery of the socket and extend parallel to the axis and surfaces which are inclined to the axis to steer the plug and socket to a coaxial condition. The parallel extending surfaces are preferably cylindrical surfaces and the inclined surfaces are preferably conical or frusto-conic.

In particular, working axially away from a socket end adjacent the oxygen port 42, towards a tip end (i.e., towards the tip of the lance) there is a first female sealing surface 45*a*, this extends to a first frusto-conic guide surface 46*a* having a radius which increases towards the tip end. First frusto-conic guide surface 46*a* extends to a second female sealing surface 45*b*. The second sealing surface 45*b* extends to a second frusto-conic guide surface 46*b*. Guide surface 46*b* extends axially and radially outwards to a first female cylindrical guide surface 47*a*. The first cylindrical guide surface 47*a* is provided on the tip most end of the cylinder 40 and ends at a shoulder which forms part of the junction with the skirt 41. A cylindrical surface of the skirt 41 provides a third sealing surface 45*c*. The sealing surface 45*c* extends to a shoulder which extends radially out to a second cylindrical guide surface 47*b*. The second cylindrical guide surface 47*b* extends axially to a third frusto-conic guide surface 46*c*. The third frusto conic guide surface 46*c* extends radially out to a fourth sealing surface 45*d* which ends at a fourth frusto conic guide surface 46*d*.

The lance body comprises an inner oxygen pipe 3, an outer oxygen pipe 3', an inner water pipe 4 and an outer water pipe 5 each spaced concentrically about a lance body axis. The inner oxygen pipe 3 provides a passage for oxygen to be delivered to the lance tip from the oxygen port 42. An annular oxygen delivery passage between the inner and outer oxygen pipes 3,3' is for the delivery of post burn oxygen. The annular water delivery passage formed between the outer oxygen pipe 3' and the inner water pipe 4 is for the delivery of coolant water and a water return passage between the inner and outer water pipes 4,5 is for the return of the coolant water.

The head end of the lance body 2 remote from the tip is capped with a manifold plug assembly into which relatively projecting ends of the pipes 3,3',4,5 are received. The plug assembly provides a plug part of the lance body 2 adapted for reception in the socket to form a plug and socket junction. In particular various male sealing surfaces and both cylindrical and frusto-conic guide surfaces are provided for cooperation with the female sealing surfaces and guide surfaces of the socket. The plug assembly is comprised of a top end part which engages the inner and outer oxygen pipes 3,3' and a bottom end part. An oxygen reception port on the axis of the plug assembly communicates with the oxygen passage in the inner oxygen pipe 3. A first male cylindrical sealing surface 48*a* extends from the top end of the plug assembly towards the bottom and is dimensioned to provide a clearance fit in the female sealing surface 45*a*. An annular groove is cut into the first male sealing surface 48*a* to retain a first O-ring 49*a* which engages between the male and female sealing surfaces to provide a sealing element. The first O-ring isolates the oxygen supply from the post burn supply when the plug assembly is fully installed in the socket.

Towards the bottom, and axially coincident with the post burn oxygen port 43, apertures 50 are provided through the first male sealing surface 48*a* to communicate with the post burn oxygen passage.

The first male sealing surface 48*a* extends to a first male frusto-conic guide surface 51*a* which extends radially out to a second male cylindrical sealing surface 48*b*. The second male cylindrical sealing surface 48*b* has a radius to form a clearance fit in the second female cylindrical sealing surface 45*b*. An annular groove is cut into the second male sealing surface to retain a second O-ring 49*b* which provides a sealing element to act between the second sealing surfaces 45*b* and 48*b*.

The second male sealing surface 48*b* extends to a second frusto-conic guide surface 51*b*. Second frusto-conic guide surface 51*b* extends radially out to a first male cylindrical guide surface 52*a*. The first male cylindrical guide surface 52*a* has a radius to provide a close sliding fit in the first female cylindrical guide surface 47*a*.

The first male cylindrical guide surface 52*a* extends to an annular channel 53 disposed to cooperate with the water delivery port 44. The annular channel 53 communicates with the water delivery passage via holes 54 bored parallel to the axis. The annular channel 53 extends to a flange, which extends radially out and by means of which the socket end part of the plug assembly is bolted to a tip end part.

A third frusto-conic guide surface 51*c* is formed on the tip end part of the plug assembly immediately adjacent the flange. The third frusto-conic guide surface 51*c* extends to a third male sealing surface 48*c*. The third male sealing surface 48*c* has a radius to form a clearance fit with the third female sealing surface 45*c*. A sealing element is provided by a third O-ring 48*c* retained in an annular groove formed in the third male sealing surface 48*c*. The third male sealing surface extends to a fourth male frusto-conical guide surface 51*d* which extends to a second male cylindrical guide surface 52*b*. The second cylindrical guide surface 52*b* has a radius to form a close sliding fit with the second female cylindrical guide surface.

A ring of apertures 54 are formed in an annular channel 55 extending around the second cylindrical guide surface 52*b*. The apertures 54 and the channel communicate with the water return port 44' and the water return passage.

The annular channel 55 extends to a fifth frusto conical guide surface 51*e*. The fifth frusto conical guide surface extends to a fourth male sealing surface 48*d* which forms a clearance fit with the fourth female sealing surface 45*d*.

The fourth male sealing surface 48*d* is provided with an O-ring seal 49*d* retained in an annular groove for sealing engagement between the sealing surfaces 45*d* and 48*d*.

It will be realised that the provision of frusto-conic guide surface on each of the head and the plug part ensures that the plug part is steered onto the axis of the head as it is inserted so that the head and plug may be considerably out of alignment prior to insertion of the plug and yet the lance body can still be reliably coupled with the head.

The axial separation of the cylindrical guide surfaces is arranged so that the second cylindrical guide surfaces 47*b* and 52*b* are engaged before any of the cooperating sealing surfaces are axially coincident. Consequently there is no risk of the sealing surfaces abrading each other or damaging the O-rings 49.

Because there is no problem with abrasion of the sealing surfaces the sealing surfaces 45 and 48 have anti-corrosion coatings such as bronze plasma coating.

The radial separation of all the cylindrical surfaces, particularly the sealing surfaces, ensures that there is contact only between an O-ring 16 and the sealing surface against which it is meant to seal. This minimises wear on the O-rings 16 and maximises reliability.

Figure 6C:
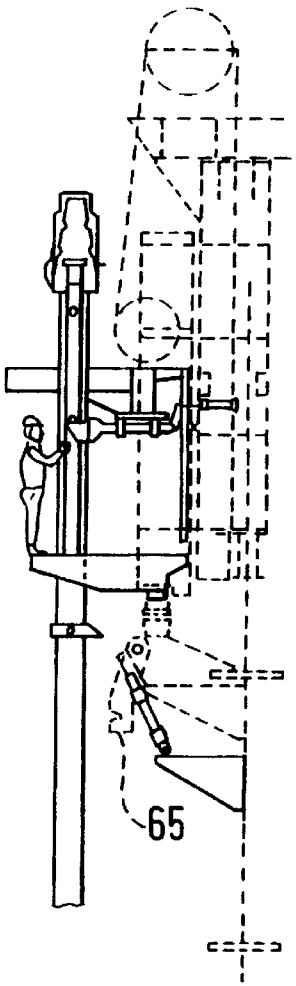
FIGS. 6*a*, 6*b* and 6*c* illustrate an apparatus and method for lance body exchange.
Figure 6B:
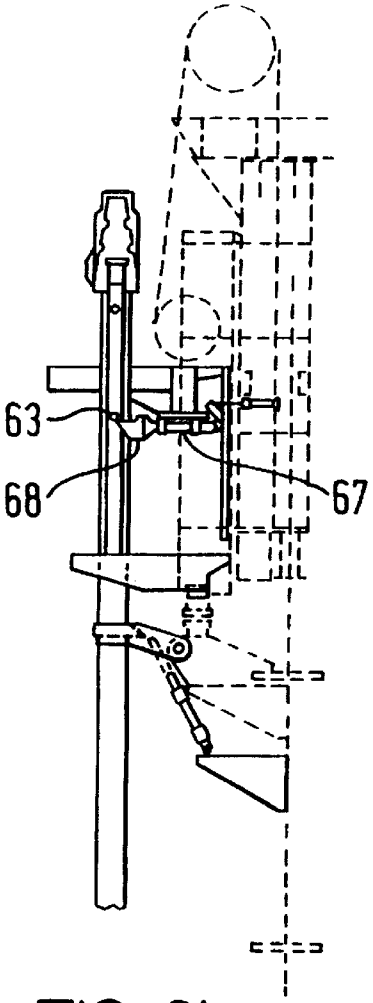
Figure 6A:
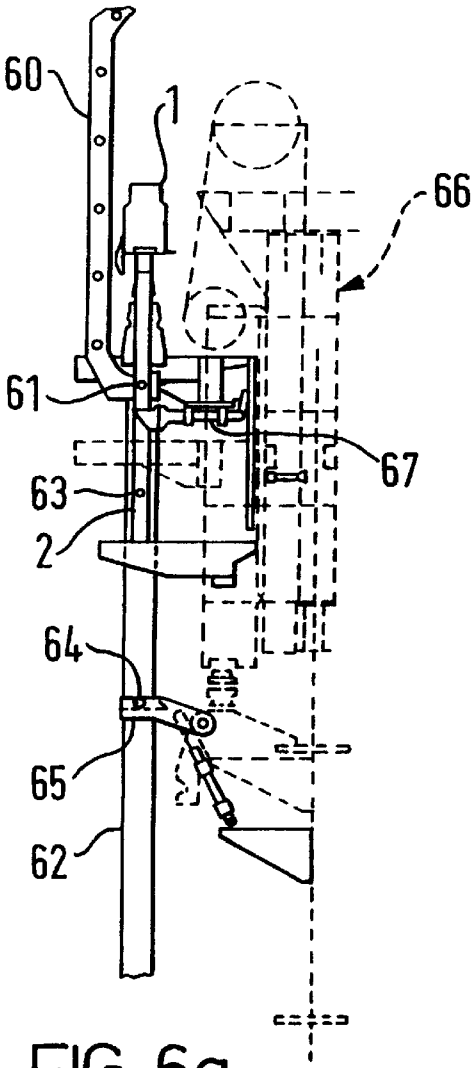

FIGS. 6*a* to 6*c* illustrate a preferred carriage and clamping apparatus whereby a lance body 2 can be exchanged in a lance head 1.

FIG. 6*a* shows the replacement lance body 2 suspended from a crane 60 by means of upper trunnions 61 projecting from the sides of the lance body 2. The lance body 2 is steered into a position between a pair of opposing vertical channel section guides 62 which have passages (not shown) formed in the sides through which the upper trunnions 61 pass. Middle trunnions 63 and lower trunnions 64 are also provided on the lance body 2. These also pass through passages (not shown) provided in the guides 62.

A temporary support arm 65 is pivotally mounted on a gantry and is pivoted into a horizontal position by means of a ram. The end of the arm is provided with notches into which the lower trunnions 64 seat when lowered by the crane 60. The lance body 2 is now securely supported by the support arm 65 and the channels 62 and the crane 60 can be removed.

The head 1 is carried on a vertically displaceable carriage 66, as is a clamping arm 67. While the lance body 2 is brought in by the crane 60 the carriage 66 is at a raised position as shown in FIG. 6*a*. Once the lance body 2 is supported on the support arm the carriage 66 is lowered as shown in FIG. 6*b* so that the head 1 is lowered onto the lance body 2.

The head 1 and lance body 2 are supported on the carriage to permit some relative lateral and pivotal movement between them so that in the process of lowering the carriage 66 the head 1 is guided by means of the previously described guide surfaces onto the plug end of the lance body 2 to form the plug and socket junction.

The clamping arm 67 is telescopically mounted on the carriage 66 and spring biased to the extended position shown in FIGS. 6*a* and 6*c*. A ram is provided to retract the clamping arm 67 as shown in FIG. 6*b* as the carriage is lowered so that a claw 68 on the end of the clamping arm 67 can pass around the middle trunnions 63. The clamping arm is then extended so that the middle trunnions 63 seat on to the claw 68. The support arm 65 is now retracted as shown in FIG. 6*c* and the lance head 1 and lance body 2 are clamped together and can be raised and lowered by the carriage 66 ready for use.

The process of installing the lance body 2 is reversed to remove the lance body 2.

What is claimed is:

1. An oxygen lance assembly comprising:

a head and a lance body, a plug part being formed on the lance body, a socket being formed in the head to receive the plug part and so form a plug and socket junction whereby the lance body and the plug part can quickly be exchanged, as a unit, by plugging and unplugging the plug part in the socket, sealing surfaces of the plug part being provided exclusively by a plurality of cylindrical peripherally extending axially spaced male mating surfaces and, sealing surfaces of the socket being provided exclusively by a plurality of cylindrical peripherally extending female mating surfaces spaced axially to cooperate one each with each male mating surface to separate passages for the transport of oxygen or coolant through the plug and socket junction, wherein annular sealing elements are mounted to be retained one each on each male mating surface of the plug to engage between cooperating male and female mating surfaces, whereby the plug and socket junction is tolerant of displacement and misalignment in the axial direction.

2. An assembly according to claim 1 further comprising guide surfaces radially spaced from the mating surfaces arranged to progressively correct any misalignment of the mating surfaces before the mating surfaces engage during installation of the plug part in the socket.

3. An assembly according to claim 2 wherein the guide surfaces comprise frusto-conic surfaces.

4. An assembly according to claim 2 wherein cooperating guide surfaces on the plug part and the socket have a sliding fit tolerance and the mating surfaces provided by the cooperating sealing surfaces on the socket and the plug part have a clearance fit.

5. An assembly according to claim 3 wherein at least one guide surface on the plug part is disposed to engage with the cooperating guide surface in the socket before the sealing surface on the socket and plug part engage.

6. An assembly according to claim 1 wherein at least some of the sealing surfaces are coated to resist corrosion.

7. An assembly according to claim 1 wherein a part of the socket on which are formed the sealing surfaces is made from a skirt of stainless steel.

8. An assembly according to claim 1 wherein the sealing elements are O-ring seals retained in annular grooves.

9. An assembly according to claim 1 wherein the radius of each mating surface is greater than that of any mating surface relatively towards the interior of the socket.

10. An oxygen lance assembly comprising:

a head and a lance body, a plug part being formed on one of the head and lance body, a socket being formed in the other of the head and lance body to receive the plug part and so form a plug and socket junction whereby the lance body and the plug part can quickly be exchanged, as a unit, by plugging and unplugging the plug part in the socket, the plug part having male mating surfaces provided by a plurality of cylindrical peripherally extending axially spaced surfaces and, the socket having a plurality of cylindrical peripherally extending female mating surfaces spaced axially to cooperate one each with each male mating surface to separate passages for the transport of oxygen or coolant through the plug and socket junction, wherein the mating surfaces are provided by sealing surfaces dimensioned so that cooperating male and female mating surfaces mate with a clearance, and wherein male guide surfaces are provided on the plug to engage corresponding female guide surfaces provided in the socket which act to align the male and female mating surfaces before they mate and maintain the clearance of the male and female mating surfaces after they mate.

11. An oxygen lance assembly according to claim 10 wherein each of the mating surfaces has a radius greater than that of every mating surface relatively towards the interior of the socket.

12. An oxygen lance assembly according to claim 10 further comprising a guide surface inclined towards the axis to coaxially center the plug part on insertion to the socket.

13. An oxygen lance assembly according to claim 11 wherein the inclined guide surface is a frusto-conic guide surface.

14. An oxygen lance assembly according to claim 10 further comprising cooperating male and female guide surfaces extending parallel to the axis to maintain the clearance between the mating surfaces.

15. An oxygen lance assembly according to claim 14 wherein the parallel extending guide surface is provided by a cylindrical guide surface.

16. An oxygen lance assembly according to claim 1 in combination with a lance body exchange system comprising a support structure, the lance body having a suspension means adapted for cooperation with the support structure whereby the lance body can be statically suspended while the lance head is displaced vertically, the suspension means permitting relative motion between the lance head and the lance body in a direction perpendicular to the axis to accommodate radial misalignment of the lance head and lance body to effect the connection and disconnection of the lance head and the lance body.

17. A system according to claim 16 wherein the support structure comprises vertically extending guide channels and a retractable support arm capable of engaging suspension means provided on the lance body.

18. A system according to claim 16 wherein the head is supported on a vertically displaceable carriage mounted on the support structure.

19. A system according to claim 16 wherein a clamping arm is extensibly mounted on the carriage to engage suspension means remote from the head on the lance body so that the lance body can be clamped to the head and the carriage for use.

20. A process of operating a lance body exchange system according to claim 16 comprising the steps of:

statically supporting the lance body, unclamping the junction of the lance body and the lance head and lifting the lance head away from the lance body, statically suspending a replacement lance body, lowering the lance head onto the replacement lance body so that the weight of the lance head forces sealing surfaces of the lance head together with the sealing surfaces of the lance body, clamping the lance head to the lance body ready for use.

21. An oxygen lance assembly according to claim 10 in combination with a lance body exchange system comprising a support structure, the lance body having a suspension means adapted for cooperation with the support structure whereby the lance body can be statically suspended while the lance head is displaced vertically, the suspension means permitting relative motion between the lance head and the lance body in a direction perpendicular to the axis to accommodate radial misalignment of the lance head and lance body to effect the connection and disconnection of the lance head and the lance body.

22. A system according to claim 10 wherein the support structure comprises vertically extending guide channels and a retractable support arm capable of engaging suspension means provided on the lance body.

23. A system according to claim 10 wherein the head is supported on a vertically displaceable carriage mounted on the support structure.

24. A system according to claim 10 wherein a clamping arm is extensibly mounted on the carriage to engage suspension means remote from the head on the lance body so that the lance body can be clamped to the head and the carriage for use.

25. A process of operating a lance body exchange system according to claim 10 comprising the steps of:

statically supporting the lance body, unclamping the junction of the lance body and the lance head and lifting the lance head away from the lance body, statically suspending a replacement lance body, lowering the lance head onto the replacement lance body so that the weight of the lance head forces sealing surfaces of the lance head together with the sealing surfaces of the lance body, clamping the lance head to the lance body ready for use.

* * * * *